US007858205B2

(12) United States Patent
Allen et al.

(10) Patent No.: US 7,858,205 B2
(45) Date of Patent: Dec. 28, 2010

(54) BIMETALLIC BOND LAYER FOR THERMAL BARRIER COATING ON SUPERALLOY

(75) Inventors: David B. Allen, Oviedo, FL (US); Andrew J. Burns, Orlando, FL (US); Ramesh Subramanian, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 56 days.

(21) Appl. No.: 12/203,248

(22) Filed: Sep. 3, 2008

(65) Prior Publication Data

US 2009/0110954 A1 Apr. 30, 2009

Related U.S. Application Data

(60) Provisional application No. 60/973,570, filed on Sep. 19, 2007.

(51) Int. Cl.
*B32B 15/04* (2006.01)
*B32B 18/00* (2006.01)

(52) U.S. Cl. ..... 428/633; 428/678; 428/680; 416/241 R

(58) Field of Classification Search ..... None
See application file for complete search history.

(56) References Cited

U.S. PATENT DOCUMENTS

| | | | |
|---|---|---|---|
| 5,579,534 | A | 11/1996 | Itoh et al. |
| 5,891,267 | A | 4/1999 | Schaeffer et al. |
| 6,168,874 | B1 | 1/2001 | Gupta et al. |
| 6,207,297 | B1 | 3/2001 | Sabol et al. |
| 6,296,447 | B1 | 10/2001 | Rigney et al. |
| 6,296,945 | B1 | 10/2001 | Subramanian |
| 6,306,524 | B1 | 10/2001 | Spitsberg et al. |
| 6,376,015 | B1 | 4/2002 | Rickerby |
| 6,440,496 | B1 | 8/2002 | Gupta et al. |
| 6,555,179 | B1 | 4/2003 | Reeves et al. |
| 6,610,419 | B1 | 8/2003 | Stamm |
| 6,677,064 | B1 | 1/2004 | Subramanian |
| 6,752,883 | B2 * | 6/2004 | Ishida et al. ..... 148/428 |
| 6,896,488 | B2 | 5/2005 | Bruce et al. |
| 6,924,046 | B2 | 8/2005 | Stamm |
| 6,946,208 | B2 | 9/2005 | Subramanian et al. |
| 7,150,921 | B2 | 12/2006 | Nelson et al. |
| 7,198,462 | B2 | 4/2007 | Merrill et al. |
| 7,244,467 | B2 | 7/2007 | Grossman et al. |

(Continued)

FOREIGN PATENT DOCUMENTS

| | | |
|---|---|---|
| EP | 0905280 A2 | 3/1999 |

(Continued)

*Primary Examiner*—Aaron Austin

(57) ABSTRACT

A bimetallic bond layer (26, 28) for a thermal barrier coating or TBC (30) on a superalloy substrate (22) for a high temperature environment. An interlayer (26) is applied on the substrate. A bond coat (28) comprising a CoNiCrAlY or NiCoCrAlY alloy is applied on the interlayer. A ceramic TBC (30) such as 8YSZ is applied on the bond coat. The interlayer (26) is an alloy that is compatible with the substrate and the bond coat, and that blocks or delays diffusion of aluminum from the bond coat into the substrate at high operating temperatures. This preserves aluminum in the bond coat that maintains a beneficial alumina scale (29) between the bond coat and the TBC. This delays spalling of the TBC, and lengthens the coating and component life.

3 Claims, 2 Drawing Sheets

U.S. PATENT DOCUMENTS

| | | | |
|---|---|---|---|
| 7,250,222 | B2 | 7/2007 | Halberstadt et al. |
| 2002/0132132 | A1 | 9/2002 | Bose et al. |
| 2003/0054108 | A1 | 3/2003 | Beele |
| 2005/0287296 | A1 | 12/2005 | Wadley et al. |
| 2006/0051608 | A1 | 3/2006 | Halberstadt et al. |
| 2007/0087210 | A1 | 4/2007 | Sahoo et al. |
| 2007/0116980 | A1 | 5/2007 | Schmitz et al. |
| 2007/0128360 | A1 | 6/2007 | Gorman et al. |
| 2007/0134418 | A1 | 6/2007 | Wortman et al. |
| 2008/0274368 | A1 * | 11/2008 | Kruger et al. ..... 428/621 |
| 2008/0298975 | A1 * | 12/2008 | James et al. ..... 416/229 A |

FOREIGN PATENT DOCUMENTS

| | | | |
|---|---|---|---|
| EP | 1327702 | A1 | 7/2003 |
| EP | 1536040 | A1 | 6/2005 |
| WO | WO 2006094845 | A1 * | 9/2006 |

* cited by examiner

FIG 2 1000X Magnification, Short thermal exposure time
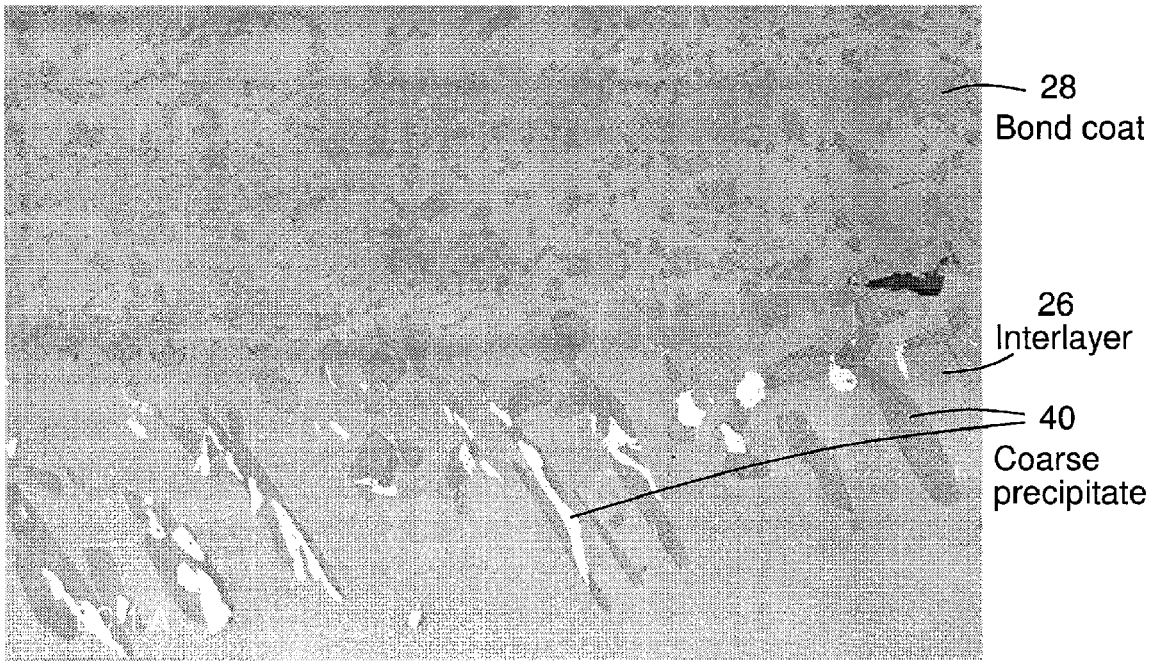
FIG 3 1000X Magnification, Long thermal exposure time
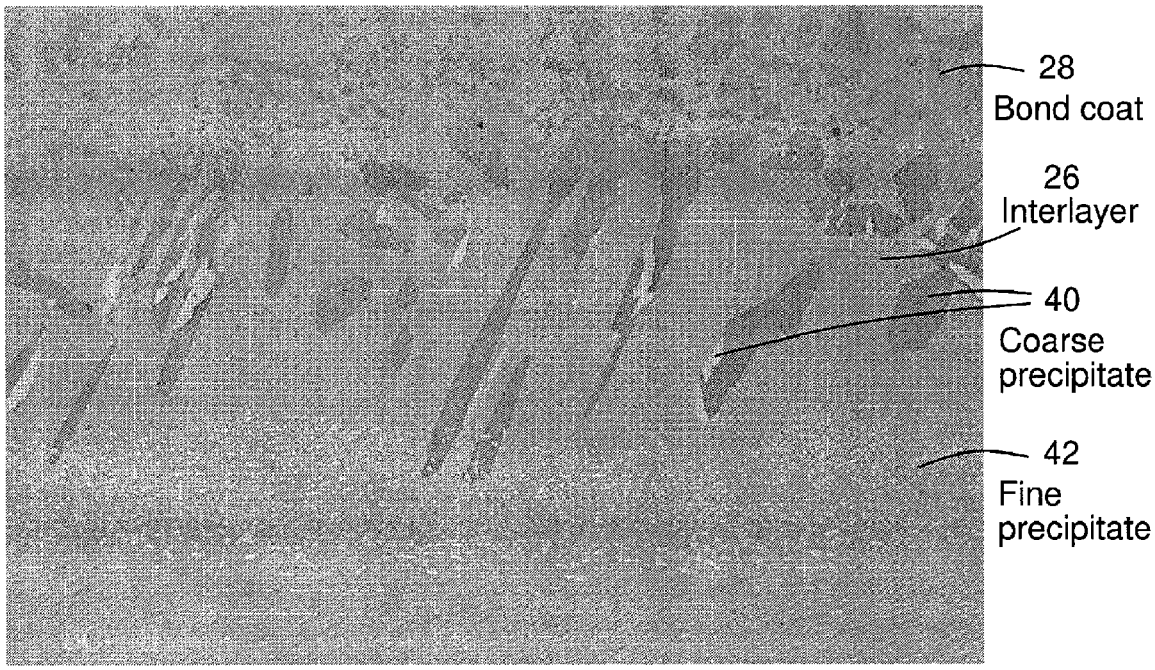

BIMETALLIC BOND LAYER FOR THERMAL BARRIER COATING ON SUPERALLOY

CROSS-REFERENCE TO RELATED APPLICATIONS

This application claims the benefit of U.S. provisional patent application 60/973,570 filed 19 Sep. 2007.

FIELD OF THE INVENTION

The invention relates to thermal barrier coatings for nickel or cobalt-based superalloy components in high temperature environments, especially in gas turbines.

BACKGROUND OF THE INVENTION

Thermal barrier coating (TBC) spallation life during service in a gas turbine engine is largely determined by the chemical composition of the substrate and the interaction of the substrate with the coating system. Substrates are typically made of a high temperature metal alloy such as a gamma prime strengthened nickel superalloy or a cobalt-based superalloy. If a given superalloy substrate has a low concentration of aluminum or a high concentration of titanium, or if the majority element of the superalloy is cobalt (alloys such as ECY 768 and X-45), aluminum in a desired bond coat material such as a CoNiCrAlY or NiCoCrAlY alloy may diffuse rapidly into the superalloy, thereby depleting the bond coat and reducing the effective life of the coating system. Due to the requirement for high strength at elevated temperatures in turbine applications, the choice of substrate is often decided on the basis of creep strength, corrosion resistance and fatigue life, rather than on coating compatibility. Cost and manufacturing concerns such as castability and weldability are also prime drivers in alloy selection. As a result, many of the common superalloys used in aero and land-based turbines have compositions that are unfavorable for bond coat compatibility.

Some gas turbines of the present assignee use a superalloy known in the industry as IN-939 for selected components in the hot gas flow path, such as in the first two rows of turbine vanes. These components rely on TBCs to reduce metal temperature to meet the component design life. If the TBC spalls, the component life will be reduced, increasing engine maintenance, part scrap rate, and repair costs. IN-939 has several properties that make it desirable for stationary hot section components, including low cost, good castability, good weldability and excellent fatigue life. However, IN939 has a relatively low aluminum content and a relatively high titanium content, which rapidly depletes the aluminum-rich beta phase of the bond coat as well as diffusing the harmful element titanium into the bond coat, resulting in decreased coating life. Laboratory furnace cycling tests have shown that TBC life on IN-939 is significantly lower than TBC life on substrates made from more coating-compatible known alloys such as Haynes 230, Mar M002, or CM247. Changing from IN-939 to such an alloy that has better coating compatibility would be one means of increasing coating life, but this is often not feasible for reasons of cost or material requirements. For example, Haynes 230 does not possess the high temperature strength of IN-939, and CM247 is more expensive, harder to cast, and more difficult to weld than IN-939. However, both Haynes 230 and CM247 have far superior oxidation resistance compared to IN-939, which is important for component life after TBC spallation.

BRIEF DESCRIPTION OF THE DRAWINGS

The invention is explained in the following description in view of the drawings that show:

FIG. 2 is a micrograph of an interlayer/bond coat interface after a short thermal stress exposure time.

FIG. 3 is a micrograph of an interlayer/bond coat interface after a long thermal stress exposure time.

DETAILED DESCRIPTION OF THE INVENTION

Figure 1:
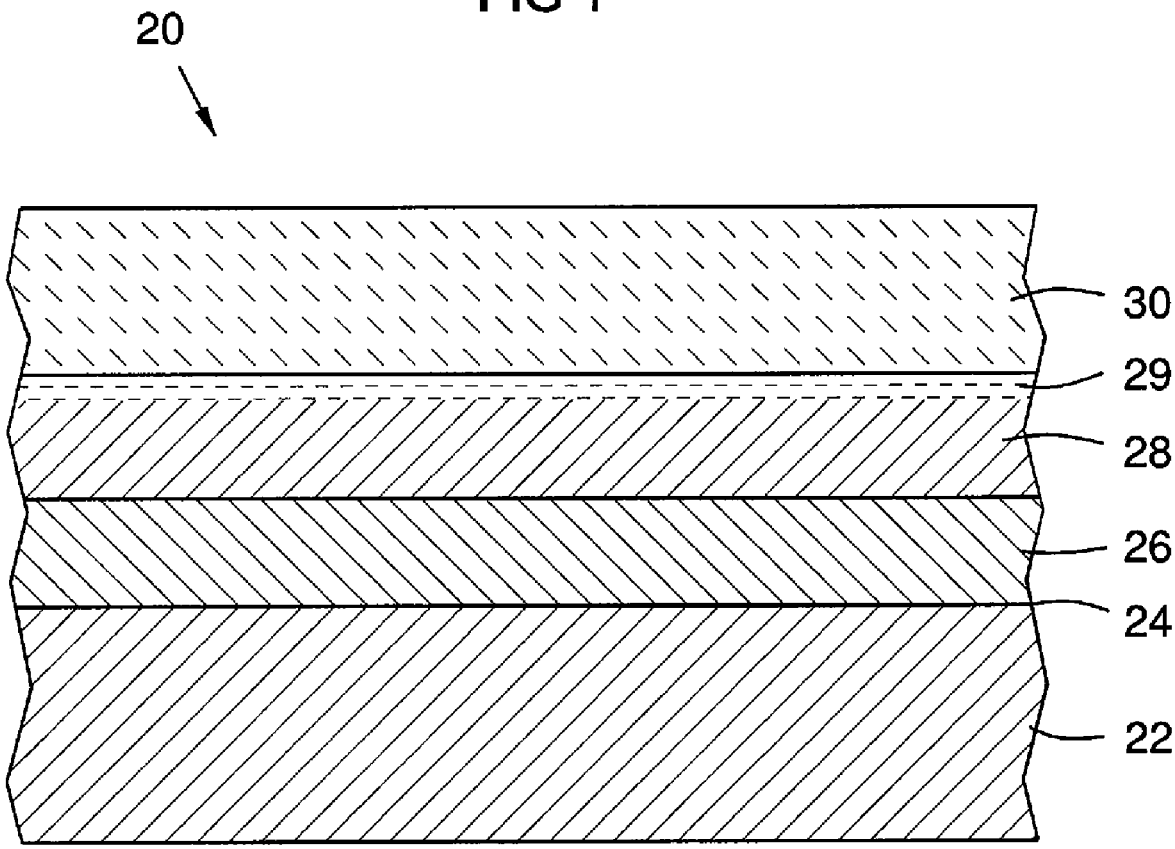
FIG. 1 is a schematic sectional view of a substrate with a layered coating according to aspects of the invention.

The inventors recognized that TBC life could be increased by introduction of a thin metallic interlayer between the superalloy substrate and the bond coat. The interlayer material may be selected from superalloys that have lower strength and/or higher cost than that of the substrate, or that have higher strength but are harder to cast and weld. The interlayer may be deposited on the superalloy substrate by conventional thermal spraying of a metal powder in a process that yields a dense, adherent coating, such as high velocity oxy-fuel (HVOF) or, in applications where space is limited such as interior part diameters, via air plasma spray (APS) or shrouded plasma.

FIG. 1 shows a coated component 20, with a substrate 22, a substrate surface 24, an interlayer 26, a bond coat 28, an alumina scale 29 on the bond coat, and a ceramic thermal barrier coating 30. The metallic interlayer 26 may be selected from any alloy known to possess good coating compatibility and further selected to provide the required strength or ductility for the given application. The primary alloying elements that promote good coating compatibility for the interlayer are those that retard bond coat aluminum depletion. This is important since the oxides formed after bond coat depletion are less desirable than the primarily aluminum oxide 29 formed before depletion. Decreased aluminum depletion may be accomplished by choosing an interlayer 26 containing:

a) Nickel base (meaning that Nickel is the greatest constituent, but not necessarily 50 wt % or more of the total weight).

b) Chromium content of at least about 8 wt %.

c) Aluminum content of at least about 0.2 wt % d) Titanium content at most about 1.75 wt % e) Element(s) that form an interfacial layer that retards aluminum diffusion into the substrate, such as at least one element selected from Nd 0.1 to 3 wt %, Re 0.2 to 1.5 wt %, and Hf 0.1-2.0 wt %

Table 1 below lists nominal compositions by weight % of certain alloys specifically discussed as examples herein. These compositions may vary within ranges as known in the industry. The number of decimal digits does not indicate a required precision. The "Interlayer" column shows an approximate possible range for elements in the interlayer, based on the minimum and maximum for each element in three suggested interlayer alloys: Haynes 230, Mar M002, and CM247.

TABLE 1

| Nominal Compositions of Alloys (wt %) | | | | | |
|---|---|---|---|---|---|
| | IN-939 | Haynes 230 | Mar M002 | CM247 | Interlayer |
| Ni | base | base | base | base | base |
| Cr | 22.0-22.8 | 13.00-15.00 | 8.0-10.0 | 8.0-8.5 | 8-15 |
| Co | 18.5-19.5 | 5.0 max | 9.0-11.0 | 9.0-9.5 | 0-11 |

TABLE 1-continued

| Nominal Compositions of Alloys (wt %) | | | | | |
|---|---|---|---|---|---|
| | IN-939 | Haynes 230 | Mar M002 | CM247 | Interlayer |
| Fe | 0.5 max | 3.0 max | 0.5 max | 0.15 max | 0-3 |
| C | 0.13-0.17 | 0.05-0.15 | 0.12-0.17 | 0.07-0.08 | 0.05-0.17 |
| Mo | | 1.0-3.0 | 0.5 max | 0.4-0.6 | 0-3 |
| Al | 1.8-2.0 | 0.2-0.5 | 5.25-5.75 | 5.4-5.7 | 0.2-5.75 |
| Ti | 3.6-3.8 | 0.10 max | 1.25-1.75 | 0.6-0.9 | 0.0-1.75 |
| Nb | 0.9-1.1 | | | | |
| Ta | 1.3-1.5 | | 2.25-2.75 | 3.1-3.3 | 0-3.3 |
| W | 1.8-2.2 | 13.00-15.00 | 9.5-10.5 | 9.3-9.7 | 9.3-15 |
| Mn | 0.2 max | 0.30-1.00 | 0.10 max | 0.10 max | 0-1 |
| Si | 0.2 max | 0.25-0.75 | 0.100 max | 0.04 max | 0-0.75 |
| La | | 0.005-0.050 | | | 0-0.05 |
| B | 0.004-0.0106 | 0.015 max | 0.01-0.02 | 0.01-0.02 | 0-0.02 |
| Hf | | | 0.8-1.7 | 1.4-1.6 | 0-1.7 |
| Zr | 0.020-0.140 | | 0.03-0.05 | 0.005-0.020 | 0-.05 |

One or more elements may be added to an interlayer alloy of Table 1 to further retard aluminum diffusion into the substrate. Table 2 shows addition amounts of such elements for each suggested interlayer alloy of Table 1 to achieve a given range of the additional element(s) in the interlayer.

TABLE 2

| Additions of one or more elements to respective alloys (wt %) | | | | |
|---|---|---|---|---|
| | Haynes 230 | Mar M002 | CM247 | Interlayer |
| Nd | 0.1-0.3 | 0.1-0.3 | 0.1-0.3 | 0.1-0.3 |
| Re | 0.2-1.5 | 0.2-1.5 | 0.2-1.5 | 0.2-1.5 |
| Hf | 0.1-2.0 | 0.0-0.2 | 0.4-0.6 | 0.1-2.0 |

The component surface 24 to be coated may be prepared by grit-blasting to produce a rough finish. Then a thin layer such as 75-300 microns thickness of a metal alloy known to possess compatibility with CoNiCrAlY, NiCoCrAlY, or CoNiCrAlY—Re bond coats may be thermally sprayed onto the component surface. For example, a thin layer of Haynes 230, Mar M002, or CM247 may be thermally sprayed onto an IN-939 substrate. A CoNiCrAlY or NiCoCrAlY or other conventional composition of bond coat 28 containing about 8-15 wt. % aluminum and also with rare earth additions other than yttrium (examples include Re and Nd) may then be sprayed onto the metallic interlayer 26, followed by an outer ceramic TBO 30 such as yttrium-stabilized zirconia. Common bond coat trade names include Amdry 995C, Co-111, Sicoat 2231 and 2264. Common ceramic TBC trade names include Metco 204NS, ZR)-110 and YB-102. During thermal cycling, the interlayer 26 acts to reduce elemental depletion of the bond coat 28, and thus increases coating life. Also, the interlayer 26 can act as a barrier to diffusion of unwanted elements from the substrate, delaying the coating performance degradation effects. The invention is especially applicable to gas turbine engine components. It provides an inexpensive and fully retrofittable method of increasing TBC spallation life and increasing oxidation resistance of the substrate without changing the base alloy.

For example, a 250 micron thick interlayer of Mar M002 powder may be sprayed via HVOF onto an IN-939 component such as a turbine vane. The vane is then HVOF-sprayed with a 150 micron thickness layer of a bond coat such as a CoNiCrAlY alloy, then APS sprayed with 250 microns thickness of an 8YSZ (8 wt % Yttrium Stabilized Zirconia) TBC. Another example is to substitute Haynes 230 or CM247 for the Mar M002 The HVOF thermal spray process is known in the industry for applying metallic coatings. Mar M002, CM247, and Haynes 230 powders are commercially available from suppliers of thermal spray powders. The thermal spray parameters for Mar M002, CM247, and Haynes 230 powders are similar to those used for bond coats.

To test the effectiveness of the invention, IN-939 pins were coated with 250 microns of CM247 via HVOF, followed by 150 microns of a rough CoNiCrAlY bond coat via HVOF. As a baseline group, bare IN-939 pins were bond coated. All pins were then sprayed with a 375 micron thick porous 8YSZ layer via APS. The pins were sectioned to create cylindrical specimens for thermal cycling. Thermal cycling tests were run in 24 hour increments, at four temperatures. At some temperatures, a 40-50% increase in TBC spallation life was observed. For example, at 1010° C. the average TBC spallation times increased from 3522 hours to 5088 hours. This improvement in coating life was attributed to reduced bond coat depletion when the interlayer was present.

As shown in FIGS. 2 and 3, the interface between certain alloys (CM247 is provided herein for reference) and conventional bond coats (CoNiCrAlY is provided herein for reference) contains one or more intermetallic precipitate phases that provide the unique advantage of retarding the diffusion of aluminum from the bond coat into the substrate alloy. This has the effect of significantly increasing the time required to deplete the aluminum from the bond coat, thus increasing the effective life of the bond coat. The precipitate that forms is coarse 40 and acicular just near the bond coat/interlayer interface at short thermal exposure times. A second layer of precipitates which is finer 42 and more equiaxed forms near the substrate at longer exposure times. FIG. 2 shows the coarse precipitates that form at short exposure times in the CM247/CoNiCrAlY system and FIG. 3 shows the finer precipitates that form in this system at longer exposure times.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A bimetallic bond layer for a thermal barrier coating on a superalloy component, comprising:

a superalloy substrate;

an interlayer on the substrate;

a bond coat comprising a CoNiCrAlY or NiCoCrAlY alloy on the interlayer;

the interlayer comprising an alloy that blocks or delays diffusion of aluminum from the bond coat into the substrate at an operating temperature over 900° C. via the formation of one or more intermetallic precipitate phases in the interlayer; and a ceramic thermal barrier coating on the bond coat;

wherein the interlayer comprises a nickel base, at most about 1.75 wt % titanium, at least about 8 wt % chromium, at least about 0.2 wt % aluminum, and at least one element selected from Nd 0.1 to 3 wt %, Re 0.2 to 1.5 wt %, and Hf 0.1-2.0 wt %;

wherein the interlayer comprises a Haynes 230 alloy with addition of said at least one element; and wherein the substrate comprises an IN-939 alloy, and the ceramic thermal barrier coating comprises porous yttrium stabilized zirconia.

2. The bimetallic bond layer of claim 1, wherein the interlayer comprises Nd 0.1 to 3 wt %.

3. A bimetallic bond layer for a thermal barrier coating on a superalloy component, comprising:

a superalloy substrate;

an interlayer on the substrate;

a bond coat comprising a CoNiCrAlY or NiCoCrAlY alloy on the interlayer;

the interlayer comprising an alloy that blocks or delays diffusion of aluminum from the bond coat into the substrate at an operating temperature over 900° C. via the formation of one or more intermetallic precipitate phases in the interlayer; and a ceramic thermal barrier coating on the bond coat;

wherein the interlayer comprises a nickel base, at most about 1.75 wt % titanium, at least about 8 wt % chromium, at least about 0.2 wt % aluminum, and at least one element selected from Nd 0.1 to 3 wt %, Re 0.2 to 1.5 wt %, and Hf 0.1-2.0 wt %; and wherein the interlayer comprises a Haynes 230 alloy with addition of said at least one element.

* * * * *